US005314092A

United States Patent [19]

Jacobsen et al.

[11] Patent Number: 5,314,092

[45] Date of Patent: May 24, 1994

[54] MATERIAL DISPENSING TOOL AND PLUNGER FOR CYLINDRICAL CARTRIDGES

[76] Inventors: Kenneth H. Jacobsen, 921 N. Quentin Rd., Palatine, Ill. 60067; Louis F. Cole, 672 Constitution Dr., Unit 93-5, Palatine, Ill. 60074

[21] Appl. No.: 14,114

[22] Filed: Feb. 5, 1993

[51] Int. Cl.[5] ..... B67D 5/52

[52] U.S. Cl. ..... 222/137; 222/327; 222/391

[58] Field of Search ..... 222/137, 145, 327, 386, 222/391

[56] References Cited

U.S. PATENT DOCUMENTS

| | | | |
|---|---|---|---|
| 2,826,339 | 3/1958 | Maillard | 222/137 |
| 3,117,696 | 1/1964 | Herman et al. | 222/137 |
| 4,067,479 | 1/1978 | Moline | 222/137 |
| 4,840,294 | 6/1989 | Ernst | 222/391 |
| 4,934,827 | 6/1990 | Taschke et al. | 222/137 |
| 5,104,005 | 4/1992 | Schneider, Jr. et al. | 222/137 |
| 5,263,614 | 11/1993 | Jacobsen et al. | 222/137 |

*Primary Examiner*—Andres Kashnikow

*Assistant Examiner*—Philippe Derakshani

*Attorney, Agent, or Firm*—Charles F. Lind

[57] ABSTRACT

The disclosed tool dispenses material from a tubular cartridge having a front closure wall and nozzle, and having a wiper closing an open cartridge end and slidable forwardly within the cartridge. A plunger sized to fit within the cartridge is carried on a rod for moving the plunger axially within the cartridge against the wiper. The plunger has a conically ramped surface expanding from its smallest adjacent a front shoulder to its largest adjacent a rear shoulder, and rear and front peripherical guide surfaces extended endwardly from the radial shoulders to cooperate with the cartridge. An O-ring surrounding the ramped surface is movable between the radial shoulders, the O-ring and ramped surface being sized with the O-ring against the rear shoulder to seat between the cartridge and plunger for sealing against rearward material leakage therepast and being sized with the O-ring against the front shoulder to be gapped from between the cartridge and plunger for cartridge venting to withdraw the plunger from the open cartridge end.

20 Claims, 4 Drawing Sheets

MATERIAL DISPENSING TOOL AND PLUNGER FOR CYLINDRICAL CARTRIDGES

BACKGROUND OF THE INVENTION

Caulk, adhesive, potting material and other fluid systems are commonly contained in tubular or cylindrical cartridges of the type having a closure wall with an outlet nozzle at one end and an opposite open end that is closed by a wiper slidably seated against the inside face of the cartridge wall. Generally, the fluid system utilizes only a single component which is used directly as discharged from a single cartridge. Multiple component material systems also exist and are formed by blending different components together in precise ratios just before the intended end use of the composite material.

Most contained fluid materials are substantially incompressible and many have poor flow characteristics and/or high viscosities. The material is discharged from the outlet nozzle by increasing the static pressures of the material within the cartridge sufficiently to overcome all back pressures against such flow. A restricted flexible tubing or the like commonly is connected over the outlet nozzle for improving flow control, such as for directing the material into narrow cracks or cavities, further increasing the needed static discharge pressures. The static pressures should be maintained substantially uniform in order to provide a consistent material discharge.

Dispensing tools are available to force a plunger axially of and into the open cartridge end and against the wiper, for generating the static pressures needed to discharge the contained material from the cartridge. Such dispensing tools conventionally utilize a rod connected to the plunger and a power device, activated by a control such as a trigger, that forces the rod and its plunger axially through the cartridge. Such dispensing tools generally are powered pneumatically, or manually such as by some type of manual ratchet mechanism indexed incrementally upon each trigger squeeze. High ratio manual ratchet mechanisms are available to generate most needed plunger forces and static material pressures.

High static pressures however promote material leakage past the wiper and out the open rear cartridge end. Leakage is messy and potentially damaging to the surroundings or tool user. Moreover, leakage of a multiple component material system could modify the desired component ratios, possibly adversely changing the expected physical properties of the resulting material.

Existing multiple component dispensing tools commonly hold the separate cartridges in adjacent side-by-side relationship, and advance separate plungers in unison through the respective cartridges. A mixing tube is connected over the separate cartridge nozzles, for blending the components together throughly before being discharged as the intended material from a single nozzle. Higher static pressures are required for this blending action. Large cartridge diameters can be used to provide for adequate volumetric capacity and/or specific component ratios, again with resulting increased plunger forces. The drive rod commonly is offset from a plane extended through the spaced multiple component plunger rods, creating an offset couple between the strained drive and plunger rods. Consequently, during even normal tool operation, forces tend to deform the tool and/or twist the wiper out of square with its cartridge walls, further inducing material leakage.

Existing material suppliers use cartridges of different and frequently incompatible designs, whereby a dispensing for one supplier's cartridges cannot accommodate the cartridges of other suppliers. Thus, a tradesman user may need different dispensing tools on hand in order to use the material cartridges provided for a specific job.

Common multiple component materials include two-part epoxies, urethanes, silicones, phenolics, acrylics and polyesters. One successful use of a multiple component material has been filling surface cracks in concrete structures to restore its structural integrity.

Our copending patent application having Ser. No. 07/882,836 filed May 14, 1992, now U.S. Pat. No. 5,263,614, patented Nov. 23, 1993, discloses related manual dispensing tools of the type having a spring linkage between the actuated power device and driven plunger, suited for storing and dissipating unused energy inputted to the power device for maintaining substantially continuous dispensing static pressures on the component material, such as even between successive trigger squeezes.

SUMMARY OF THE INVENTION

This invention relates to tools for dispensing material from tubular or cylindrical cartridges via outlet nozzles or the like.

A basic object of this invention is to provide a plunger suited to cooperate with a cylindrical cartridge wall for sealing against material leakage therepast, the plunger being effective with varied flow characteristic, viscosities and/or operating static pressures of the contained material, and for releasing the contained static pressures upon rearward plunger withdrawal in the cartridge.

Another object of this invention is to provide a dispensing tool plunger suited to cooperate with the cylindrical cartridge wall and cartridge wiper for reducing material leakage past the wiper and out the open rear cartridge end, the plunger being reusable with successive cartridges.

A related object of this invention is to provide a dispensing tool having a retaining front face configured to universally accommodate different cartridges of different suppliers, thereby eliminating the need for having a different dispensing tool for each supplier, and further for holding the cartridge firmly in the tool for dispensing material therefrom and for plunger withdrawal after its use from the open rear cartridge end.

Yet another object of this invention is to provide in a multiple component dispensing tool a drive and plunger rod alignment that minimizes the offset couple between the strained drive and plunger rods, for reduced tool deformation or wiper twist within the cartridge and improved overall tool operation.

BRIEF DESCRIPTION OF THE DRAWINGS

These and further objects, advantages and features of the present invention will be understood and appreciated upon reviewing the following disclosure, including as a part thereof the accompanying drawings, in which.

DETAILED DESCRIPTION OF ILLUSTRATED EMBODIMENTS

Figure 1:
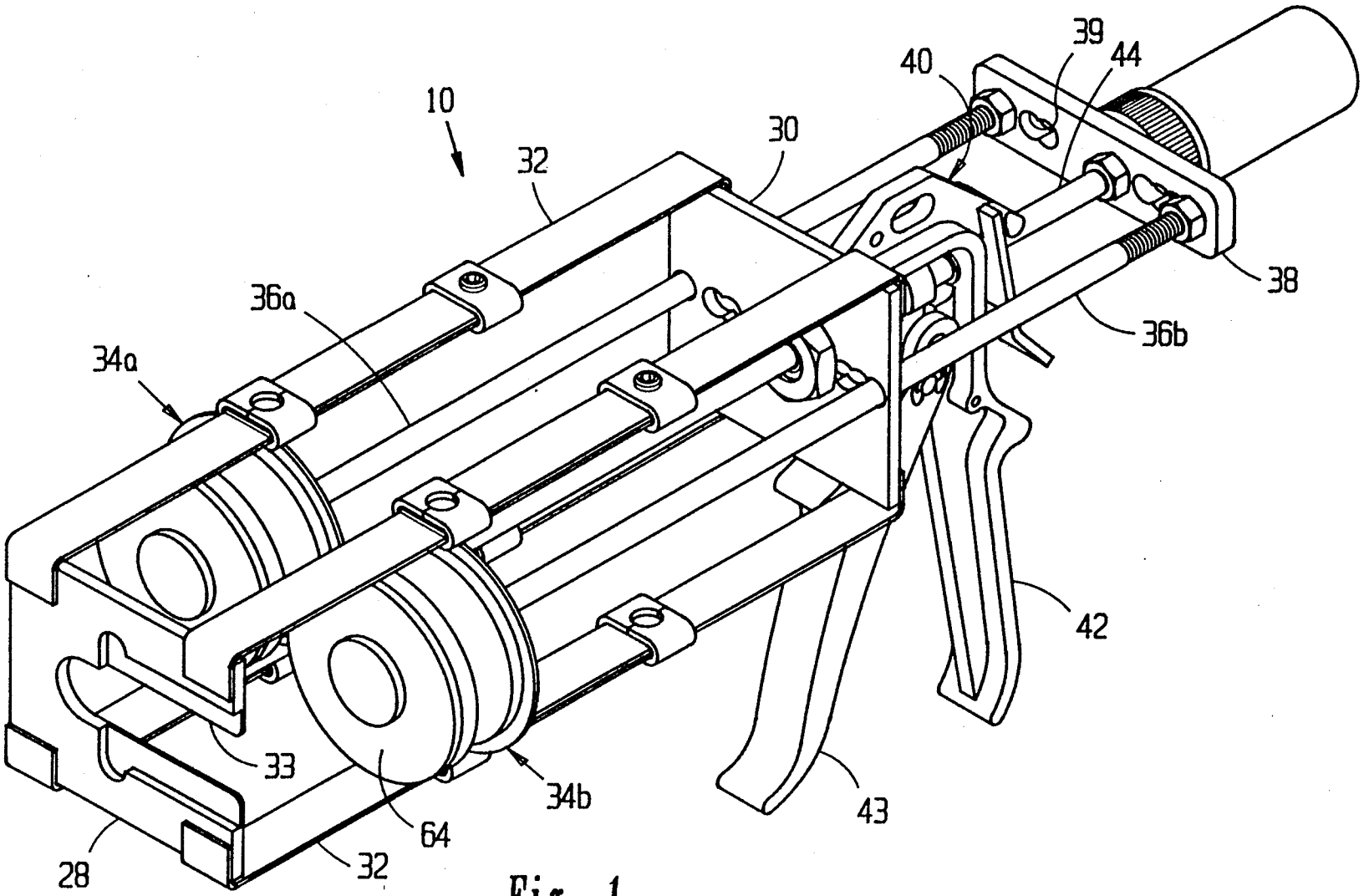
FIG. 1 is a perspective view of the dispensing tool to be disclosed herein, shown without material cartridges therein.

The dispensing tool 10 to be disclosed herein is designed for a two-component material system, to hold two separate material cartridges and to simultaneously power plungers axially within the respective cartridges to discharge the contained materials according to the ratio of the cartridge cross-sectional areas. The cartridge materials would then be mixed and blended together throughly before being discharged as a single composite material from one outlet.

Each illustrated material cartridge 12*a*, 12*b* is of a conventional design, and typically will have a generally rigid tubular or cylindrical body wall 15 with a closure wall 16 and tubular nozzle 18*a*, 18*b* at one end, and with an opposite open end 20 closed by a generally rigid wiper 22*a*, 22*b*. Each wiper 22*a*, 22*b* is likewise of a conventional design, being generally cup-shaped and having a cross wall 21 and a cylindrical side wall 23 seated slidably against the inside face of its cartridge body wall 15.

The wiper 22*a*, 22*b* is designed to be forced axially within its cartridge 12*a*, 12*b*, serving as a piston in forcing the contained material out the cartridge nozzle 18*a*, 18*b*. The contained material typically will be a paste or liquid, and will flow with varying degrees of ease depending on its viscosity and on the cross-section, length and back pressure of the nozzles and material flow paths. The static pressure generated by the advancing wiper must exceed this resistance to provide material discharge from the system. Under many operating conditions including low viscosity materials and/or high static pressures, material leakage past the conventional wiper and out the open cartridge end 20 is common.

The cartridges 12*a*, 12*b* are releasibly held together in parallel side-by-side relationship, by cooperating pin and socket structures (not shown) formed in adjacent tabs 27 and cartridge walls. As so connected, the cartridge nozzles 18*a*, 18*b* have walls shaped as equi-sized threaded half-cylinders that line up adjacent one another to define a single cylindrical threaded exterior centered approximately along the contacting sides of the cartridges. A static mixing nozzle 24 is seated over the cartridge nozzles to communicate them to its single outlet 26, and a nut 25 threaded on the exterior walls retains the static mixing nozzle in this position. The static mixing nozzle 24 has intertwined axially extended flow passages (not shown) that separate and combine repeatedly, throughly blending the materials together before their combined discharge at outlet 26.

The dispensing tool frame has opposing restraining and rear walls 28 and 30, and spaced axial members 32 connected rigidly between these walls. The material cartridges 12*a*, 12*b* fit in the tool 10 with each closure wall 16 butted against the restraining wall 28 and the nozzles 18*a*, 18*b* fitted through a slotted opening 33 therein. Plungers 34*a*, 34*b* are supported on elongated rods 36*a*, 36*b*, extended through guide openings 37 in the rear wall 30 and connected to common wall 38 at related openings 39 to line up coaxially with the respective cartridges. This arrangement operably connects the plungers to move in unison substantially between the restraining and rear walls 28 and 30. Each plunger 34*a*, 34*b* is sized to fit within its cylindrical cartridge and against the wiper 22*a*, 22*b* therein.

A conventional ratchet mechanism power device 40 is mounted by coupling member 41 on the rear wall 30, to drive each plunger axially of its respective cartridge. The power device has a stationary handle 42, and a trigger 43 pivoted on a pin relative to the handle. An elongated drive rod 44 extends generally parallel to the plunger rods 36*a*, 36*b*, slidably supported within a throughbore in the coupling member. Drive member 45 and lock member 46 releasably engage the drive rod 44, respectively to advance it forwardly toward or hold it as advanced relative to the restraining wall 28, and the trigger 43 is coupled to the drive member 45 to advance it upon the trigger being squeezed toward the handle 42.

Our copending application Ser. No. 07/882,836 discloses a resilient connection via spring 49 between the drive rod 44 and the plunger rods 36*a*, 36*b* and plungers 12*a*, 12*b*, for moving the plungers within the material cartridges.

Specifically, the drive rod 44 is fitted loosely through one of the openings 39 in wall 38, and the coil compression spring 49 is trapped on the resulting drive rod projection rearwardly between the wall and a stop 50 threaded on the drive rod 44. A stop 48 on the drive rod when bottomed against the wall 38 sets the maximum drive rod projection, adjustment of stop 50 sets the maximum spring space, and the operating resilient stroke will be the difference between the maximum spring space and the spring height when stacked solid on itself. The spring is sized to generate the static pressures and stroke needed for discharging cartridge materials under most operating conditions.

Squeezing the trigger 43 toward handle 42 axially shifts the drive member 45 forwardly toward the restraining wall 28, and the drive member carries the drive rod 44 with it. The lock member 46 holds the drive rod 44 as forwardly shifted even after the trigger 42 has been released and returned to its illustrated position. Moving the lower free end of lock member 46 toward handle 42 releases the drive rod 44, for movement rearwardly away from the restraining wall 28.

Figure 3:
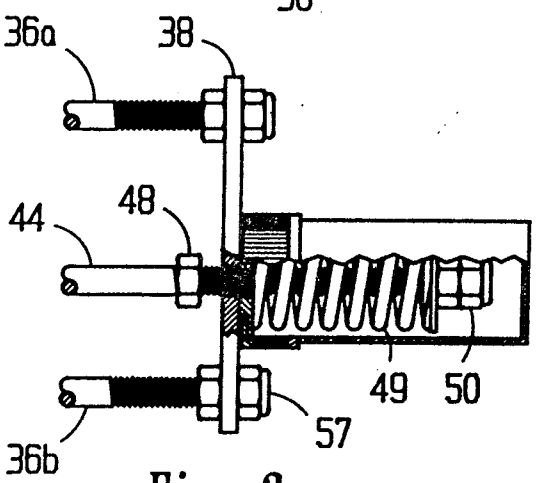
FIG. 3 is a fragmentary sectional view similar to FIG. 2, except showing the tool in a different operating position.

Each trigger squeeze thus indexes the drive rod 44 a limited power stroke. The spring 49 holds stop 48 against the connecting wall 38 only so long as the minimum static spring force is not exceeded by the force needed to advance the plungers simultaneously with the indexing drive rod 44. When plunger resistance exceeds the spring force, even momentarily, continued forward indexing of the drive rod causes the stop 48 to gap away from the wall 38 (see FIG. 3) and dynamically strains the spring 49. Plunger movement will continue at the rate determined by the spring force overcoming the plunger resistance.

Repeated trigger squeezes concurrently index the drive rod 44, requiring squeezing forces sufficient only to overcome the known spring force; but the resulting drive rod indexing will be shared between the instantaneous plunger movement and gap changes. However, should spring 49 become compressed solid to establish a solid linkage between the drive rod and plungers, further trigger activation would be possible only according to the actual advance of the plungers. The spring 49 thus dynamically stores displacement energy inputted to the drive rod but unused when the plungers cannot simultaneously be advanced in unison therewith, and thereafter continuously drives the plungers until the energy is dissipated, even between trigger squeezes.

Figure 4:
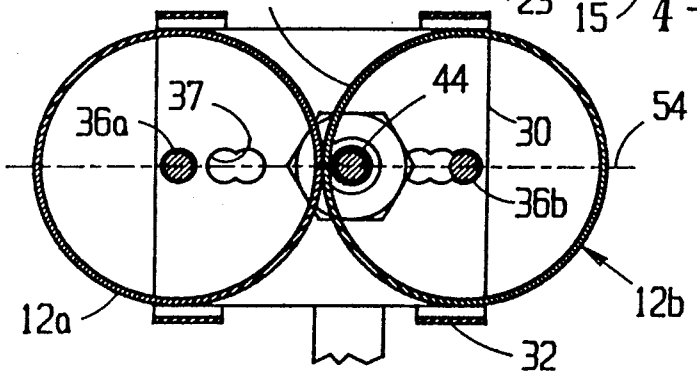
FIGS. 4 and 5 are sectional views, taken generally along lines 4—4 and 5—5 respectively in FIG. 2, except showing also the plunger in side elevation in FIG. 5.
Figures 5, 6, 7:
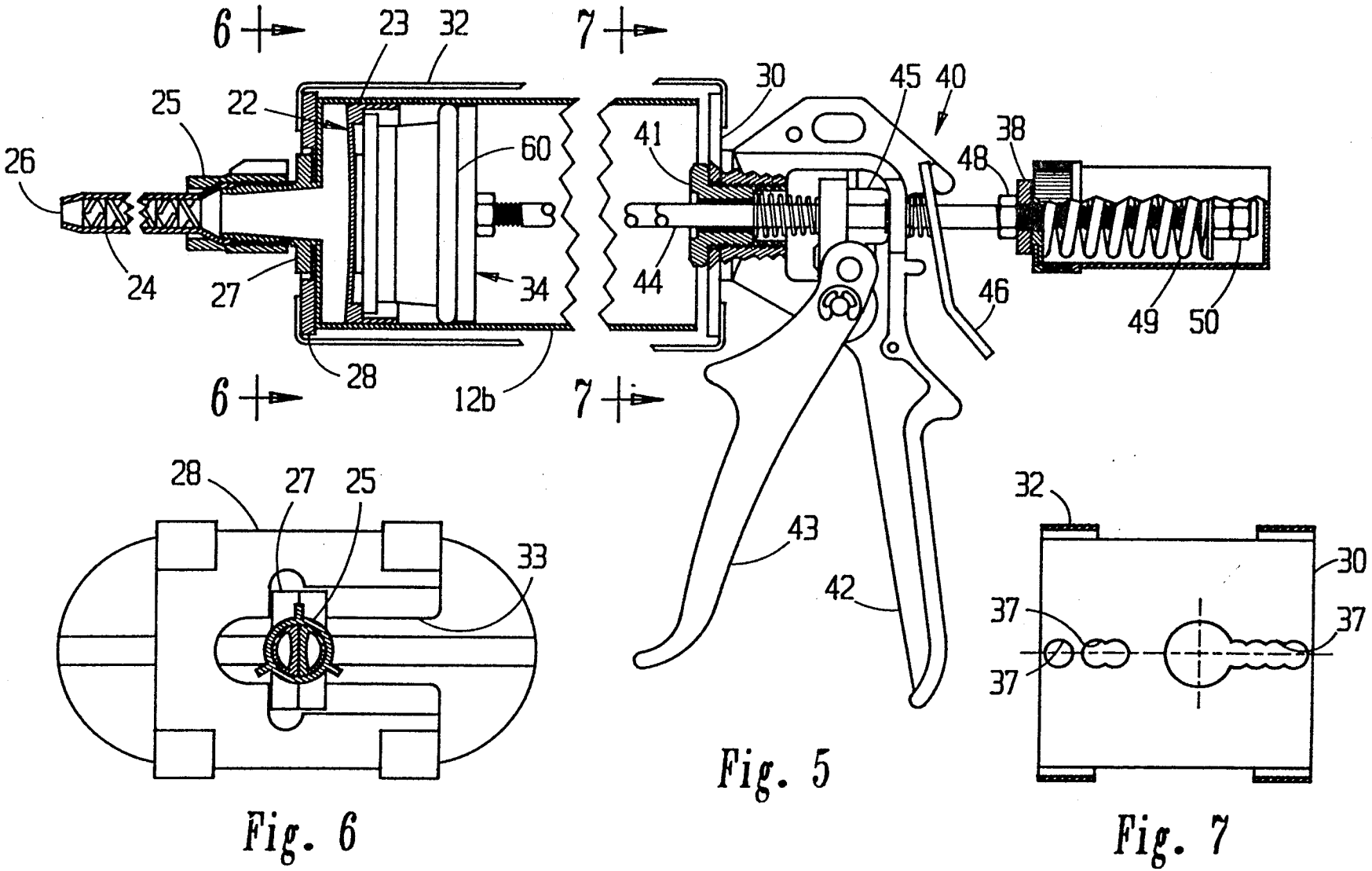
FIGS. 6 and 7 are fragmentary views, taken generally along lines 6—6 and 7—7 respectively in FIG. 5, except with the material cartridges not being illustrated in FIG. 7.
Figure 8A:
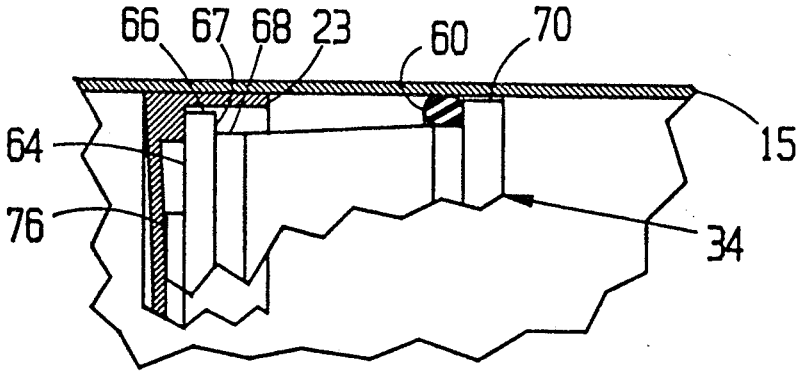
FIGS. 8*a*, 8*b* and 8*c* are fragmentary sectional views, similar to FIG. 2, except showing the compenents in alternative operating positions.
Figure 8B:
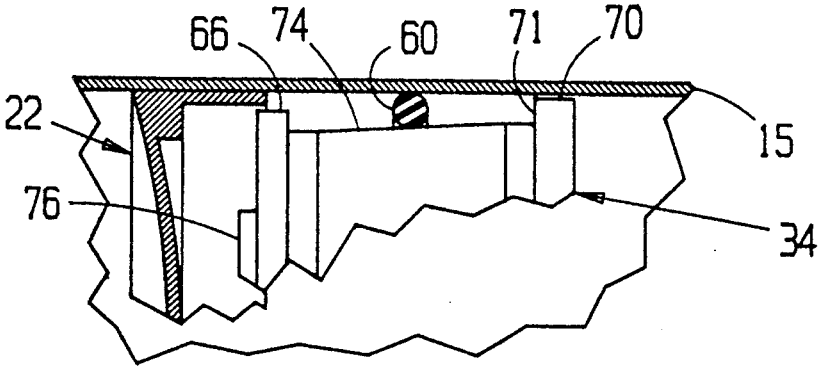
Figure 8C:
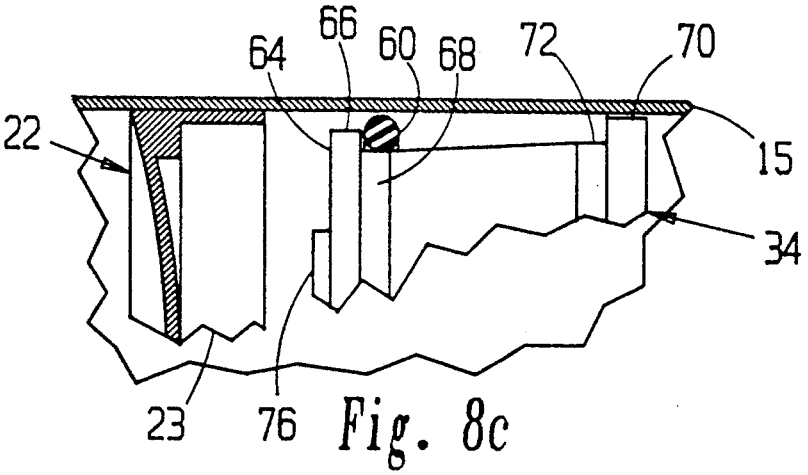

Of importance to this invention, the drive rod 44 is aligned on the plane (indicated as line 54 in FIG. 4) extended through the lunger rods 36*a*, 36*b*, to eliminate the lateral offset between the spaced plunger rods and the drive rod. The illustrated drive rod would be strained in tension and the plunger rods would be strained in compression, and any lateral offset between these rod components would generate an offset couple that must be counteracted by the rods themselves and the spaced axial members 32 connected between the opposing walls 28 and 30. This coplanar drive-plunger rod design reduces the strength and thus size needed for the structural tool components and/or provides less tool deformation during use, compared to tools having a lateral offset between the plunger rods and drive rod.

The plunger rods 36*a*, 36*b* are releasably secured relative to the connecting wall 38 by nuts 57, and the guide openings 37 and 39 in the rear and connecting walls 30 and 38 respectively are aligned at spacings corresponding to those needed for the rods to lie concentrically of different size cartridges, as might be needed for achieving specific component ratios. Overall, the dispensing tool 10 can hold two cartridges of an equal maximum size, one cartridge of that maximum size and any smaller size cartridge, or two cartridges of sizes less than the maximum.

The dispensing tool 10 further provides for aligning the drive rod 44 slightly off center between the two plunger rods, being closer to plunger rod 36*b* when the plunger rods would be located concentrically of two maximum size tool cartridges. The drive rod is spaced from the plunger rod 36*b* a distance just less than the inside radius of the maximum size cartridge 12*b*, to allow the drive rod 44 to telescope into the cartridge adjacent the cartridge wall 15. The forward end of the drive rod terminates rearwardly spaced from the rear face of the plunger 34*a* (see FIG. 2), to avoid interference between these components.

While this off center drive-plunger rod alignment can create different force couples between the drive rod and each plunger rod, the effects of such largely can be offset and minimized as a practical matter.

Thus, with equal size cartridges, the cartridge holding the more viscous material would be located over the drive rod. providing a smaller distance between the drive rod and the plunger rod requiring the larger driving force and compensating for the smaller force on the other plunger rod spaced further from the drive rod. With dissimilar size cartridges, the larger cartridge would generally be positioned over the drive rod, to locate the larger force needed with the larger cartridge a shorter distance from the drive rod than the smaller plunger forced through the smaller cartridge but spaced further from the drive rod. However, if greatly dissimilar viscous materials were also involved, it might be advantageous to position the smaller but more viscous material cartridge over the drive rod in order to even out the plunger rod forces acting on the off center drive rod.

With the coplanar and off center alignments of the drive and plunger rods, the elongated frame handle 42 and trigger 43 would lie generally perpendicular to the defined plunger rod plane 54.

Of further importance to this invention, each illustrated plunger has a rigid body, irregular in size and shape, and an O-ring 60 cooperates thereon to seal and unseal the plunger relative to the cartridge side wall 15.

Figure 2:
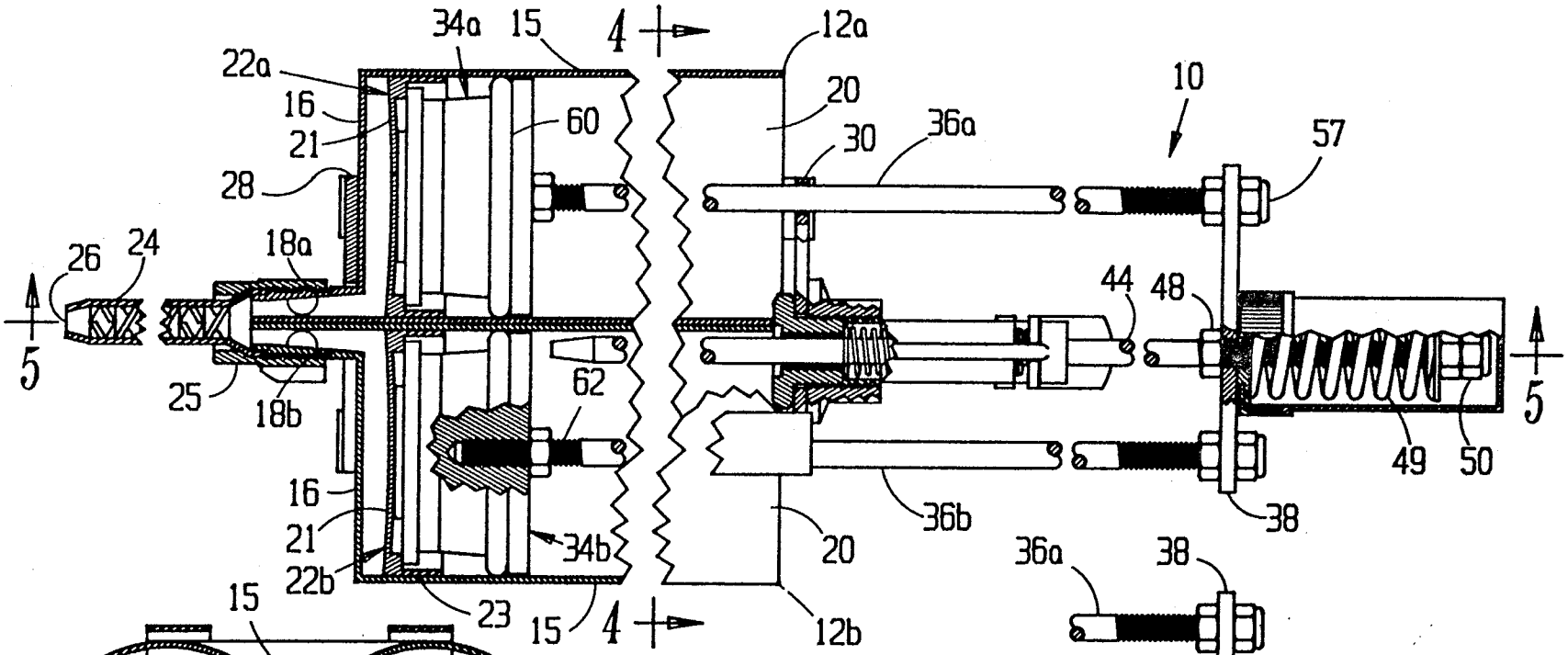
FIG. 2 is a center sectional view, referenced generally in plan with respect to the tool of FIG. 1, except showing a pair of material cartridges operatively in place therein.

Each plunger 34*a*, 34*b* (identified only as 34 in FIGS. 5, 8*a*, 8*b*, 8*c* ) is secured to its plunger rod, as by a plunger tap cooperating with a threaded end 62 of the plunger rod (see FIG. 2). The plunger has a front face 64, and concentric side surfaces, irregular in size and shape, extended rearwardly thereof. The side surfaces 66 and 70 respectively at the plunger's front and rear, are generally cylindrical in shape but of different diameters: the rear cylindrical surface 70 being sized to fit with slight radial clearance inside of the cartridge, and the front cylindrical surface 66 being smaller and sized to fit with slight radial clearance inside of the cylindrical wall 23 of the wiper 22*a*, 22*b* (identified only as 22 in FIGS. 5, 8*a*, 8*b*, 8*c* ). Each plunger is recessed between the cylindrical surfaces 66 and 70, having opposed radial shoulders 67 and 71 extended in from the cylindrical surfaces to adjacent opposite ends of a ramped surface 74, smallest adjacent the front shoulder 66 and largest adjacent the rear shoulder 70.

Each plunger has a center boss 76 raised forwardly from front face 64 very slightly (0.05–0.2"), and sized smaller generally than the front face of a conventional tool plunger to be spaced inwardly from the side surface 66. The boss 76 thereby provides initial plunger-wiper cooperation against only the intermediate portion of the wiper cross wall, flattening out the cross wall originally bowed concave toward the contained material, and then the front plunger face butts against the wiper cross wall at its periphery.

Figure 9:
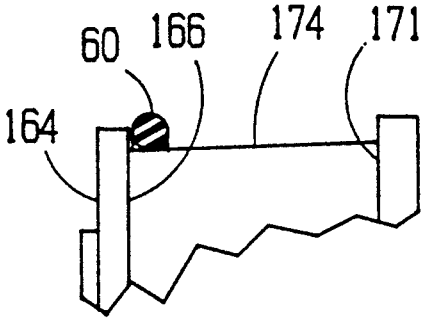
FIG. 9 is a fragmentary sectional views, similar to FIGS. 8*a*, 8*b* and 8*c*, except showing a second embodiment of a plunger suited for use in the illustrated tool.

Two plunger embodiments are illustrated: plungers 34*a*, 34*b* (34 in FIGS. 5, 8*a*, 8*b* and 8*c* ) and plunger 134 illustrated in FIG. 9.

In the plungers 34, 34*a*, 34*b* , the ramped surface 74 is generally conical, and terminates at its ends at cylindrical front and rear land areas 68 and 72, which in turn extend axially to the opposed radial shoulders 67 and 71. The cylindrical land areas 68 and 72 would extend axially a distance about equal to or just slightly less than the diameter of the O-ring 60. In plunger 134, ramped surface 174 also is generally conical, but it terminates at opposed radial shoulders 167 and 171, without any cylindrical land areas. The ramped surfaces 74, 174 are concentrically disposed relative to the cylindrical surfaces 66 and 70, and 166 and 171, and the front faces 64, 164 and center bosses 76, 176.

The largest ramped plunger surface (or land area) adjacent the rear radial shoulder is sized to position the outward edge of the O-ring radially beyond the side surface 70, 170 and snug it against the cartridge side wall, to effectively seal against rearward material leakage therepast while not creating excessive binding forces precluding forward plunger movement in the cartridge. The cylindrical land area 72 of plunger 34 might be sized accurately to accomplish this. By contrast, the smallest front ramped plunger surface (or land area) adjacent the front shoulder is spaced from the cartridge wall sufficiently to have an O-ring thereat in an nonsealing or gapped relationship between the cartridge and plunger.

When the plunger is moved forwardly in the cartridge, the O-ring binds somewhat against the cartridge wall and thereby rides up the ramped surface until seated against the rear shoulder 71. The O-ring will thus establish a seal between the plunger and cartridge. The components are preferably sized so that outward edge of the O-ring projects radially beyond the inward portions of the wiper side wall, so that should the O-ring initially be located against the front shoulder 67 (see FIG. 8*c* ) and gapped from the cartridge, the wiper will engage the O-ring and ride it up the plunger until it is radially expanded sufficiently to engage the cartridge wall.

In a preferred mode, the O-ring cross-section will be round, to in part roll on the ramped surface between the opposed radial shoulders 167 and 171. Although the O-ring will normally be stable only in the configuration where a specific circumferential tread region lies on the outer side of the O-ring. the O-ring cross-section generally can be rotated about its center axis to allow it to be rolled along the ramped surface. The components would preferably be sized to have the circumference of the O-ring cross-section just slightly less than or equal to the spacing between the opposed radial shoulders; which would allow the O-ring to roll up the ramped surface through unstable configurations while being in its stable configuration when against the front and rear shoulders.

The butting cooperation of the plunger boss against only the intermediate portion of the wiper cross wall, flattens out the cross wall and biases the wiper corner between the cross and cylindrical walls more tightly against the cartridge, as generally designed, to best maintain its sliding seal between the wiper and cartridge. The front plunger face butting against the wiper cross wall at its periphery, provides substantial and stable engagement between the wiper cross wall and plunger during continued plunger advances. The close but non binding cooperation between the plunger side surfaces and wiper, and the axial spacing between the plunger side surfaces centers the plunger within the cartridge and minimizes wiper twist out of square of the cartridge, improving the sealing effectiveness of the wiper itself. However, should high static pressures generated during tool use sufficiently expand the cartridge side wall (frequently in excess of 0.1") to gap this wiper-cartridge seal, the plunger and its resilient O-ring thereupon effectively precludes material leakage rearwardly past the plunger.

Plunger withdrawal rearwardly from the cartridge will shift the O-ring down the ramped plunger surface to become unsealed from between the cartridge and plunger, breaking any pressure or vacuum containment in the nozzle end of the cartridge. This allows easy plunger removal after the cartridge material has been totally discharged, for disposal of the cartridge and reuse of the removed plunger after cleaning as needed. Also, this plunger design operating in any cylinder containment can serve as a pressure relief means, should an excess contained pressure arise and overcome the mechanical force holding the plunger in the cylinder to rearwardly shift the plunger sufficiently within the cartridge to unseat the plunger from the cylinder.

As noted, the illustrated material cartridges are commercially available as separate individual components, and are assemblied and held in side-by-side relationship by cooperating pin and socket structures (not shown) formed in the adjacent tabs 27 and cartridge walls. The tabs 27 are rigid and extend laterally away from the threaded half-cylinder nozzles 18*a*, 18*b*, forwardly spaced only slightly from the front cartridge wall.

Another important aspect of the improved tool 10 is that the restraining wall 28, adjacent the slot 33, is stepped away to present parallel aligned ledges 80 that are spaced apart just slightly more than the threaded half-cylinder nozzles 18*a*, 18*b*, to straddle them. The ledges 80 further are sized to fit somewhat snugly between the cartridge tabs 27 and front walls 82, operable to receive the tabs as the cartridges are shifted laterally of the tool and brought into axial alignment with the plungers. Shoulders 84 defined at the ends of the ledges 80 can be abutted by the tabs to provide this cartridge-plunger alignment accurately.

This snugged interfit between the cartridge tabs 27 and tool ledges 80 firmly maintains the cartridges in place in the tool, with the front walls 82 against the restraining wall 28 and aligned axially with the plungers, for providing reliable nonbinding plunger movement forwardly into the cartridges. Moreover, the cartridges remain firmly held in place after the materials have been dispensed, easing the rearward plunger movement in withdrawing them from the cartridges.

The dispensing tool is well suited to hold different forms of commercially available cartridges, for added versatility. For example, another form of cartridge (not shown) does not use the illustrated lateral tabs or closely adjacent threaded half-cylinder nozzles that together define the threaded nozzle form for holding the mixing nozzle 24. Instead, the two cartridges are held together by tangential interlocks only, and a separate one-piece cap is sealed over the more widely separated adjacent cartridge outlet nozzles and communicates via internal passages to a single cylindrical outlet nozzle. This cap-formed outlet nozzle is similar in size to the illustrated threaded outlet.

Consequently, the same type mixing nozzle 24 can be sealed and held in place on the cap-formed outlet nozzle by a nut 25 threaded on its threaded exterior. Also, the cap-formed outlet nozzle fits in the open slot 33, which is rounded at its closed end 84 and located to be abutted by the nozzle for accurately aligning the cartridges axially with the plungers. Moreover, the nut 25 that holds the mixing nozzle in place also will be butted against the ledges 80, holding the cartridges in place when the plungers are rearwardly withdrawn from the cartridges.

Other cartridge forms can be used also in the illustrated dispensing tool. Further, while the dispensing tool has been illustrated with two cartridges, it could function to dispense material from only a single cartridge, such as a one-component material system.

While only specific embodiments of the invention have been illustrated, variations may be made therefrom without departing from the inventive concept. Accordingly, the invention is to be limited only by the scope of the following claims.

What is claimed as our invention is:

1. A tool for dispensing material from a tubular cartridge having a front closure wall with a nozzle and having an open rear end, and a wiper slidable within the cartridge and closing the open end thereof, comprising the combination of a plunger having a rigid body sized to fit within the open cartridge end, and means for supporting the plunger for axial movement within the cartridge;

said plunger body having rear and front peripherical surfaces, rear and front radial shoulders at the adjacent ends of the perpherical surfaces, and a conically ramped surface expanding from its smallest adjacent the front shoulder to its largest adjacent the rear shoulder; and an O-ring surrounding the ramped surface and movable between the radial shoulders, and said O-ring and ramped surface being sized with the O-ring against the rear shoulder operable to seat between the cartridge and ramped surface for sealing against rearward material leakage therepast and being sized with the O-ring against the front shoulder to be gapped from between the cartridge and ramped surface for cartridge venting and rearward plunger withdrawal from the cartridge.

2. A dispensing tool according to claim 1, further including the wiper having a cross wall closing the open cartridge end and a cylindrial wall slidable within the cartridge, and the rear peripherial surface being sized to fit with only slight radial clearance within the cartridge and the front peripherial surface being sized to fit with only slight radial clearance within the wiper cylindrical wall.

3. A dispensing tool according to claim 2, further including the plunger body having a front face and a slightly raised boss thereon spaced inwardly from the front peripherial surface, operable when the front peripherical plunger surface is fitted within the wiper cylindrical wall for the boss to butt initially against only the intermediate portion of the wiper cross wall to deform said wiper and provide effective sealing cooperation with the cartridge and then for the front face to butt the wiper cross wall adjacent the cylindrical wiper wall and provide substantial and stable plunger-wiper engagement within the cartridge.

4. A dispensing tool according to claim 3, further including the front and rear peripherial surfaces being cylindrical, and the peripherial surfaces, conical ramped surface and boss being concentrically arranged relative to one another.

5. A dispensing tool according to claim 2, further including the front and rear perpherical surfaces being axially spaced apart and having sufficiently close relative tolerance with the wiper and cartridge operable to center the plunger in the cartridge and to minimize wiper twist relative to the cartridge.

6. A dispensing tool according to claim 1, further including front and rear land areas extending respectively between corresponding adjacent ends of the ramped surface and the corresponding radial shoulders, and the rear land area being cylindrical and extended axially a distance generally equal to or just slightly less than the cross-section of the O-ring.

7. A dispensing tool according to claim 1, further including the ramped surface terminating at its opposite ends at the rear and front radial shoulders.

8. A dispensing tool according to claim 1, further including said cartridge having rigid tabs extended laterally from the nozzle and generally parallel to the front closure wall only slightly spaced forwardly therefrom; a restraining wall having a thickness to correspond to the spacing between the tabs and front closure wall and having a slot sized to receive the cartridge nozzle operable for holding the cartridge in the tool with the closure wall and tabs snuggly straddling the restraining wall and the cartridge and plunger being aligned axially for reliable nonbinding plunger movement forwardly and rearwardly and for plunger withdrawal from the cartridge.

9. A dispensing tool according to claim 8, further including shoulders on the restraining wall defined at the closed end of the slot operable to be butted by the cartridge tabs to provide accurate axial cartridge-plunger alignment.

10. A dispensing tool according to claim 1 for use with a second tubular cartridge also having a front closure wall and nozzle and open rear end and a wiper slidable within the cartridge and closing the same, and a static mixing nozzle sealed over the cartridge nozzles and having a common outlet for the mixed cartridge materials, further including means for supporting the cartridges in parallel side-by-side relationship and a plunger fitted within the second cartridge and against the wiper; elongated rods supporting each plunger for axial movement within its cartridge, the plunger rods being in parallel side-by-side relationship and defining a plane centered through the cartridges; a connecting member between the plunger rods allowing them to move only in unison, and an elongated drive rod operatively coupled to the connecting member for driving said plunger rods in the direction toward the closure walls, and the drive rod being parallel to said plunger rods and aligned on said plane, minimizing offset couples generated between the plunger and drive rods.

11. A dispensing tool according to claim 10, further including the drive rod being disposed off center between the plunger rods, suited to telescope into one of the open cartridge ends.

12. A tool for dispensing material from two tubular cartridges each having a front closure wall with a nozzle and having an open rear end, a wiper slidable within the cartridge and closing the open end thereof, and a static mixing nozzle sealed over the cartridge nozzles and having a common outlet for the mixed cartridge materials, comprising the combination of means for supporting the separate cartridges in tangentially contacting parallel side-by-side relationship, a plunger sized to fit within the open end of each cartridge and against the wiper, an elongated rod supporting each plunger for axial movement within the cartridge, and a connecting member between the plunger rods allowing them to move only in unison;

a rear wall adjacent the open ends of the cartridges, a power mechanism on the rear wall and having a stationary handle and a movable trigger, and an elongated drive rod operatively coupled between the trigger and the connecting member, whereby trigger activation drives said drive rod and plungers in the direction toward the front closure walls; and the plunger rods being in parallel side-by-side relationship and defining a plane extended through the cartridges generally where tangentially contacting, the drive rod being parallel to said plunger rods and aligned generally on said plane, minimizing offset couples generated between the plunger and drive rods, and being cantilevering forwardly beyond the rear wall and telescoping into one of the open cartridge ends upon trigger activation.

13. A dispensing tool according to claim 12, further including the drive rod being disposed off center between the plunger rods, suited to telescope into one of the open cartridge ends even of equal diameters.

14. A tool for dispensing material from two tubular cartridges each having a front closure wall with a nozzle and having an open rear end, a wiper slidable within the cartridge and closing the open end thereof, and a static mixing nozzle sealed over the cartridge nozzles and having a common outlet for the mixed cartridge materials, comprising the combination of means for supporting the separate cartridges in parallel side-by-side relationship, a plunger sized to fit within the open end of each cartridge and against the wiper, an elongated rod supporting each plunger for axial movement within the cartridge, and a connecting member between the plunger rods allowing them to move only in unison;

a rear wall adjacent the open ends of the cartridges, a power mechanism on the rear wall and having a stationary handle and a movable trigger, and an elongated drive rod operatively coupled between the trigger and the connecting member, whereby trigger activation drives said drive rod and plungers in the direction toward the front closure walls;

the plunger rods being in parallel side-by-side relationship and defining a plane extended through the cartridges, and the drive rod being parallel to said plunger rods and aligned generally on said plane, minimizing offset couples generated between the plunger and drive rods; and each of said plungers having a body with rear and front peripherical surfaces, rear and front radial shoulders at adjacent ends of the perpherical surfaces, and a conically ramped surface expanding from its smallest adjacent the front shoulder to its largest adjacent the rear shoulder; and an O-ring surrounding the ramped surface and movable between the radial shoulders, and said O-ring and ramped surface being sized with the O-ring against the rear shoulder operable to seat between the cartridge and ramped surface for sealing against rearward material leakage therepast and being sized with the O-ring against the front shoulder to be gapped from between the cartridge and ramped surface for cartridge venting and rearward plunger withdrawal from the cartridge.

15. A dispensing tool according to claim 14, further including the drive rod being disposed off center between the plunger rods, suited to telescope into one of the open cartridge ends.

16. A dispensing tool according to claim 15, further including said cartridges each having nozzles of half cylinders disposed closely adjacent one another to form a single cylindrical nozzle for holding the static mixing nozzle sealed hereon; rigid tabs extended laterally from each cartridge nozzle and generally parallel to the front closure wall only slightly spaced forwardly therefrom; a restraining wall having a thickness to correspond to the spacing between the tabs and front closure walls and having a slot sized to receive the cartridge nozzles operable for holding the cartridges in the tool with the respective closure walls and tabs snuggly straddling the restraining wall and the cartridges and plungers being respectively aligned axially for reliable nonbinding plunger movement forwardly and rearwardly and for plunger withdrawal from the cartridge.

17. A dispensing tool according to claim 16, further including shoulders on the restraining wall defined at the closed end of the slot operable to be butted by the cartridge tabs to provide accurate axial cartridge-plunger alignment.

18. A dispensing tool according to claim 17, further wherein the dispensing tool is suited to hold different forms of cartridges, including cartridges having more widely separated adjacent cartridge nozzles, a separate one-piece cap sealed over the cartridge nozzles and fitted in the restraining wall slot and a nut holding the static mixing nozzle relative to a common outlet from the cap, including the restraining wall slot being extended at the closed end beyond the shoulders to receive said cap while allowing the axial alignment of the plungers and cartridges, and said nut being operable to butt against the restraining wall for holding the cartridges in place for rearward plunger withdrawal from the cartridges.

19. A dispensing tool according to claim 18, further including each plunger body having a front face and a slightly raised boss thereon spaced inwardly from the front peripherial surface, operable when the front peripherical plunger surface is fitted within the wiper cylindrical wall for the boss to butt initially against only the intermediate portion of the wiper cross wall to deform said wiper and provide effective sealing cooperation with the cartridge and then for the front face to butt the wiper cross wall adjacent the cylindrical wiper wall and provide substantial and stable plunger-wiper engagement within the cartridge.

20. A dispensing tool according to claim 19, further including the front and rear peripherial surfaces being cylindrical, and the peripherial surfaces, conical ramped surface and boss being concentrically arranged relative to one another.

* * * * *